US005251394A

United States Patent [19]

Bornancini

[11] Patent Number: 5,251,394

[45] Date of Patent: Oct. 12, 1993

[54] SAFETY DEVICE FOR SEMIAUTOMATIC PISTOL

[75] Inventor: Jose C. M. Bornancini, Porto Alegre, Brazil

[73] Assignee: Forjas Taurus S/A, Porto Alegre, Brazil

[21] Appl. No.: 866,438

[22] Filed: Apr. 10, 1992

[30] Foreign Application Priority Data

Apr. 18, 1991 [BR] Brazil ..... PI 9001879

[51] Int. Cl.[5] ..... F41A 17/62

[52] U.S. Cl. ..... 42/70.05; 42/70.08; 89/27.12

[58] Field of Search ..... 42/70.05, 70.04, 70.08; 89/148, 149, 151, 152, 154, 27.12

[56] References Cited

U.S. PATENT DOCUMENTS

| | | | |
|---|---|---|---|
| 3,129,637 | 4/1964 | Packard | 42/70.04 |
| 3,442,173 | 5/1969 | Muller | 89/148 |
| 4,433,610 | 2/1984 | Tatro | 89/148 |

FOREIGN PATENT DOCUMENTS

| | | | |
|---|---|---|---|
| 2154250 | 5/1973 | Fed. Rep. of Germany | 89/148 |
| 108188 | 8/1943 | Sweden | 89/148 |

*Primary Examiner*—Stephen M. Johnson
*Attorney, Agent, or Firm*—Bachman & LaPointe

[57] ABSTRACT

The patent of invention "IMPROVED SAFETY DEVICE FOR SEMIAUTOMATIC PISTOL" discloses a safety device that comprises a set of pieces specially configurated to operate either to lock the pistol and to decock the hammer safely as well.

7 Claims, 10 Drawing Sheets

SAFETY DEVICE FOR SEMIAUTOMATIC PISTOL

BACKGROUND OF THE INVENTION

The state of art knows single action semiautomatic pistols such as Colt 1911 gun, whose hammer can be cocked by the thumb or by sliding back the breechblock either manually or due to a shot. In both cases, the hammer always stands in the same position, somewhat backwards, it being necessary only some pressure of the forefinger on the trigger to fire off.

Guns of this kind can be locked with the hammer in the cocked position. The only way to decock the gun after its unlocking is to thumb the hammer and lead it down, little by little, after pull the trigger.

The risk of accidental shots due to the trigger sensitivity when the gun is unlocked requires its carrying inside a holster always locked or with the hammer down and unlocked. In both cases, a sudden draw out of the pistol requires a conscious act to either unlock or to cock it with the thumb.

By this reason, double action pistols were developed. These, when carried unlocked and in perfect safety conditions, can fire the first shot just by pulling the trigger which, in along stroke, such as with revolvers, cocks the hammer, releasing it further for the shooting in a continuous motion. After the first shot, the hammer stands cocked like with single action pistols.

Nowadays, there are four main kinds of safety devices for double action pistols, among which there are some which afford or help afford a safe hammer decocking. The oldest one is safety lever assembled in the sliding breechblock, which nowadays appears in WHALTER mod. P-38, PPK, PP and SMITH & WESSON cal. 9 mm and .45 pistol's., further to RUCER mod, P-85 and BERETA mod. 92. In all these models, when the latch bolt is turned down to uncock the hammer, it remains down positioned, requiring an obligatory and conscious turning up for double action shooting, Exception is made with regard to the STEIR GB 9 mm pistol whose latch, when lowered to uncock the hammer safely turns back automatically to the unlock position to allow immediate double action.

Similar device can be found in pistols such as HECKLER & KOCH P9 and STAR M30, which have a safety lever assembled in the sliding breechblock, When activated, it blocks the firing pin but does not decock the hammer, which requires further pulling of the trigger. This devices requires the pulling of the trigger, after duly setting the locking lever to the lock position, in order to decock the hammer without shooting, it being necessary the unlocking of the gun for further double action shooting.

Such locking devices have yet the inconvenience of being assembled in the sliding breechblock, making difficult the operation with the thumb, and making possible an unintentional action, when operating manually over the grip to hammer cocking, to tuck the pistol in a narrow holster or pull it out.

Another device is the decocking lever, appearing in the SIG-SAUER P-226 pistols, which is not properly a safety device, but a lever located in the front grip, which, when lowered with the trigger pulled it safely decocks the hammer. After that, the lever turns up automatically to the initial position, allowing double action shooting.

Another device employs a lock assembled into the frame that just blocks the sear, and requires that the hammer be lowered through manual control, while pulling the trigger for decocking, This device appears in the BERETA 92 S, BENELLI, BERNARDELLI, CZ-75 e TAURUS PT 99 e 92, among others.

This device allows to carrying above pistols cocked and locked, in the way some self defense experts recommend based on the COLT 1911, but the double action advantage is jeopardized when the gun is set to operate in this condition due to the dangerous decocking required.

OBJECT OF THE INVENTION

An improved safety device for semiautomatic pistol is the object of the present invention, which comprises a set of pieces specially configurated, by which it promotes either the gun locking or safe decocking of the hammer.

SUMMARY OF THE INVENTION

It is scope of the present invention an improved safety device for semiautomatic pistols, of the kind assembled into the frame of the pistol comprised of three safety positions, one of them being transitory; the upper position sets in action the locking of the pistol; the transitory lower position sets in action the hammer decocking; and the horizontal neutral position that allows shooting. Said safety locking is composed by two action keys, each one disposed on each side of the pistol; the first key endowed with a transversal axle, where the hammer is assembled, and the second key with the fixation means for said axle and an arm parallel to the said axle that blocks the hammer sear actuating on the struck face of the sear while safety keys are in the upper position (locking the gun) characterized by a cam and an inner shoulder; a retentor composed by an axle with an indenture and from there a retention arm and a driving lever (not parallel in relation to each other); an ejector endowed with an indenture in its lower portion, a plunger in the ejector indenture, being activated by an helicoidal spring against the indenture of the retentor axle; a sear endowed with a lateral projection and a hammer with a dent in the lower portion of its knocking face.

The advantages and technical results of the invention will become evident from the detailed description that follows, referring to the drawings annexed hereto in which.

DETAILED DESCRIPTION OF THE INVENTION

Figure 1:
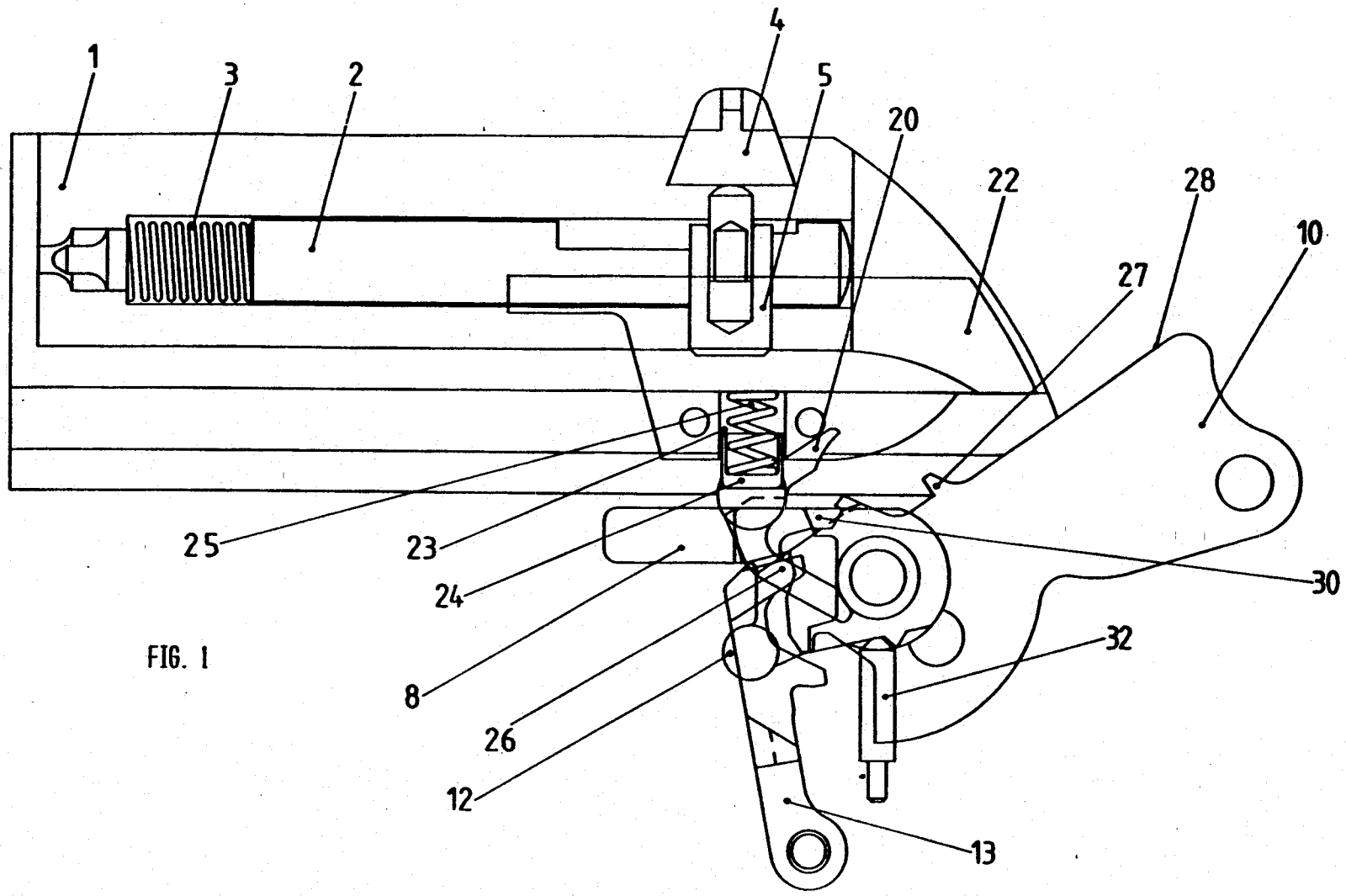
FIG. 1 is a left lateral view of the safety device object of the present invention in the configuration assumed when the hammer is cocked and the pistol is unlocked.

For best comprehension of the layout of components of the safety device, object of the present invention, the parts such as the slide (1), the firing pin (2), the firing pin spring (3), the rear sight (4), and the firing pin block (5) are showed in FIGS. 1-5 having not specific function relative to the safety device, As per attached figures, the safety device object of the present invention is of the kind assembled in the frame of the pistol, and comprises a three position safety device, where an upper position sets in action the pistol locking mechanism, a transitory lower position set in action the hammer decocking mechanism, and a neutral horizontal position that allows the shooting; said safety device being composed by two action keys (7, 8), each one disposed on each side of the pistol, from where the first key (7)(FIG. 8) has an axle (9), transversal to the pistol, on which the hammer (10) is assembled, and the second key (8) (FIG. 10) with means (11) to hold the axle (9) and an arm (12) that is parallel to the said axle (9), which blocks the hammer sear (13) acting on the strucking face of the sear (13) when both keys (7, 8) are in the locking position and is characterized by comprising a key (7) with a cam (15) and an inner indenture (16), a retentor (17) composed by an axle (18) endowed with an indenture (19) and from the axle (18) a retention arm (20) and a driving lever (21)not parallel in relation to each other, an ejector (22) endowed with grooves (23) in its lower portion, a plunger (24) that is disposed in the ejector groove cut (23), and is impelled by a helicoidal spring (25) against the indenture (19) of the axle (18) of the retentor (17); a sear (13) endowed with a lateral projection (26) and a hammer (10) endowed with a dent (27) in the lower portion of its knocking face (28).

The FIG. 1 shows schematically the safety device object of the present invention in the moment the hammer (10)is cocked, held by the sear (13), with the pistol unlocked, with the keys (7, 8) in the neutral horizontal position.

In this situation, the retention arm (20) and the driving lever (21) of the retentor (17) are disposed obliquely to the horizontal axle of the pistol, the plunger (24) being sat on the indenture (19) of the axle (18) of said retentor (17), with no torque on the same.

Figure 2:
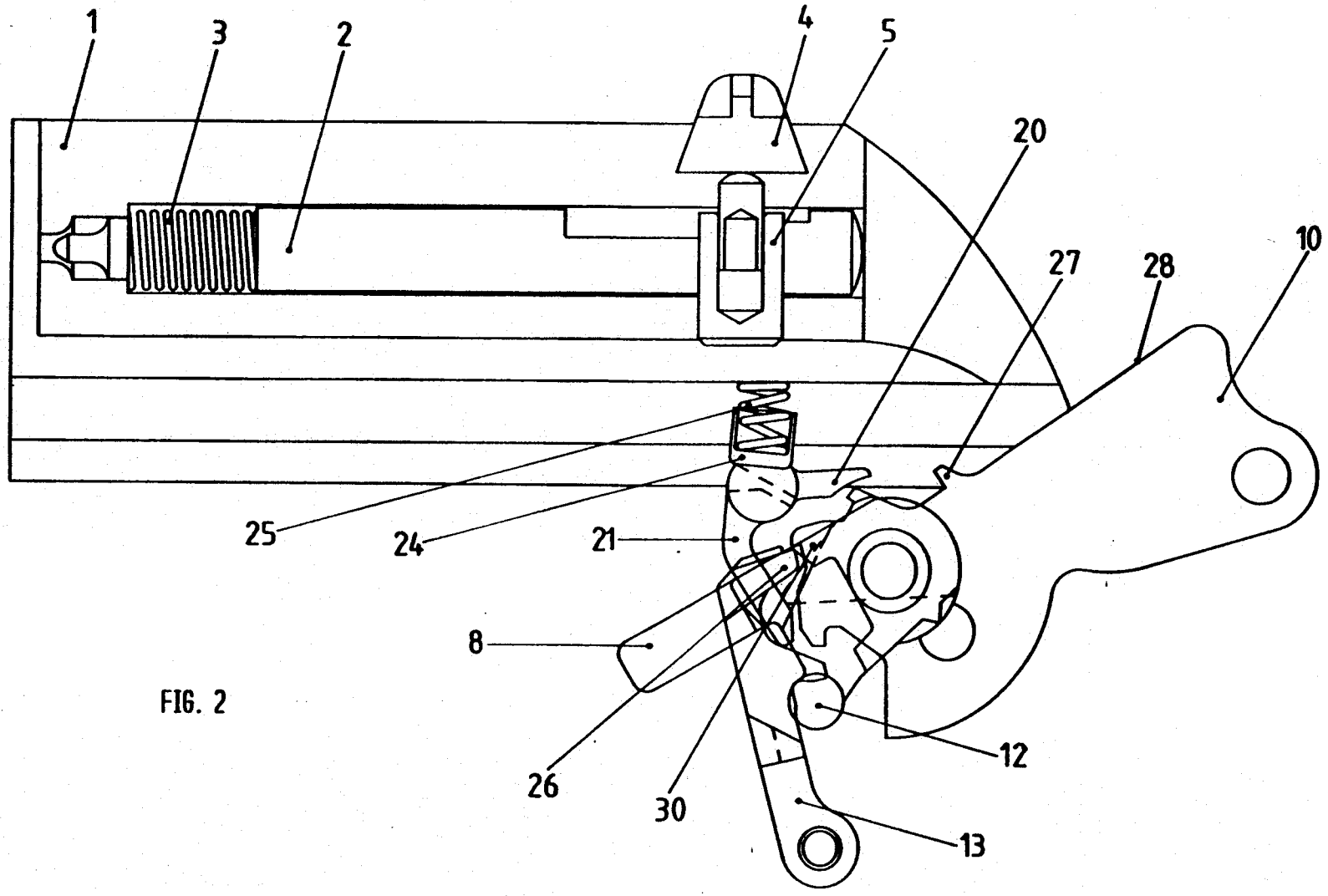
FIG. 2 is a lateral left view of the device, showing it in a hammer decocking procedure.
Figure 3:
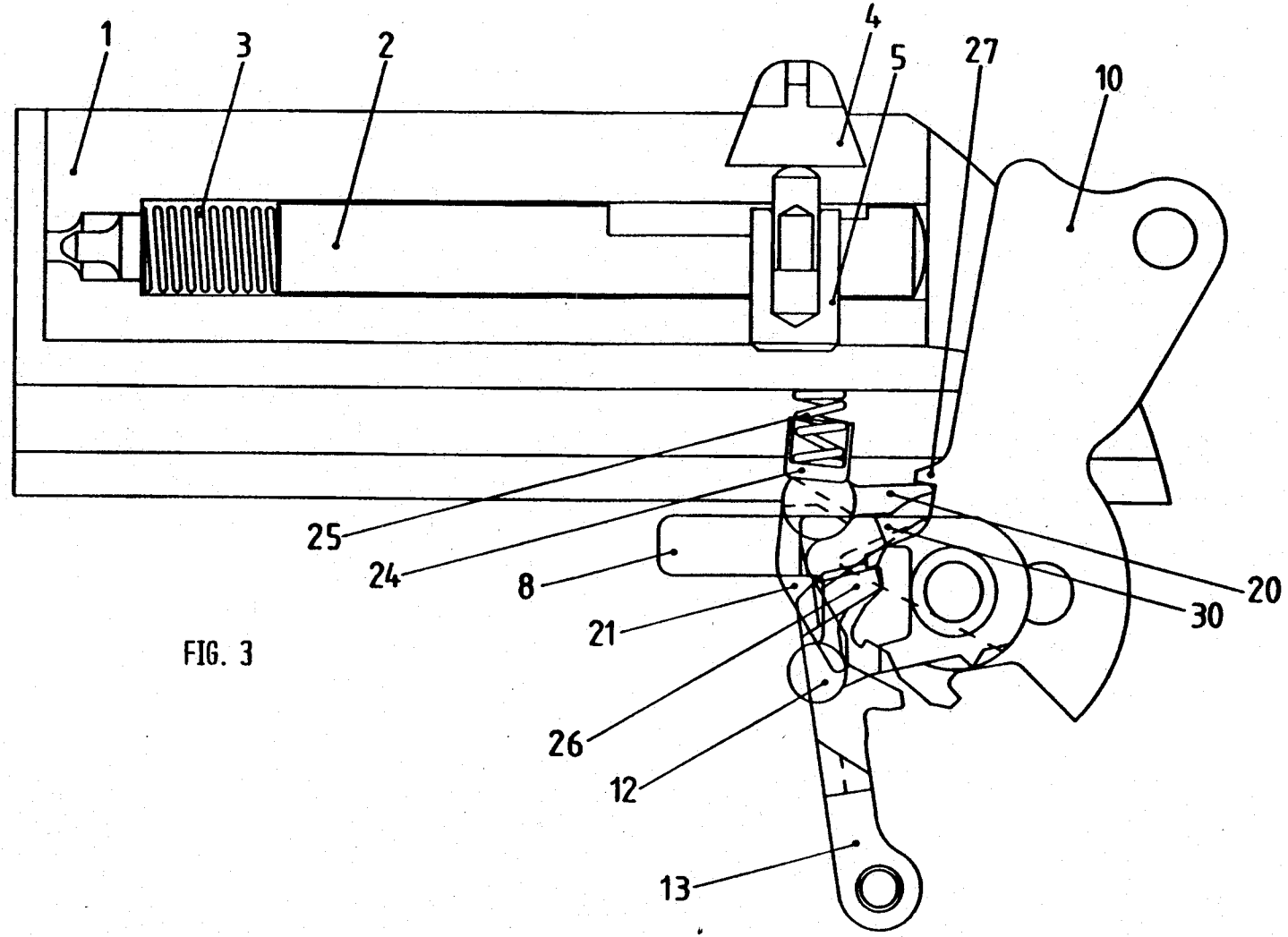
FIG. 3 is a lateral left view of the device, showing the hammer already decocked.

In order to accomplish the decocking of the hammer in complete safety, as illustrated in the FIGS. 2 and 3, it is enough to pressure on any of the keys (7, 8). This is because cam (15) of the first key (7) acts over the driving lever (21) of the retentor (17) when the keys (7, 8) go from the neutral horizontal position to the lower position with the hammer (10) cocked, making the said retentor (17) perform a rotation movement on its axle (18), what pressure the plunger (24) against the groove cut (23) of the ejector (22) compressing the helicoidal spring (25), making that the same plunger (24) exerts torque over the edge of the indenture (19), positioning horizontally the retention arm (20) simultaneously to the action of the arm (30) of the second key (8) on the lateral projection (26) of the sear (13), releasing the hammer (10) which strikes against the tip of the retention arm (20).

Figure 4:
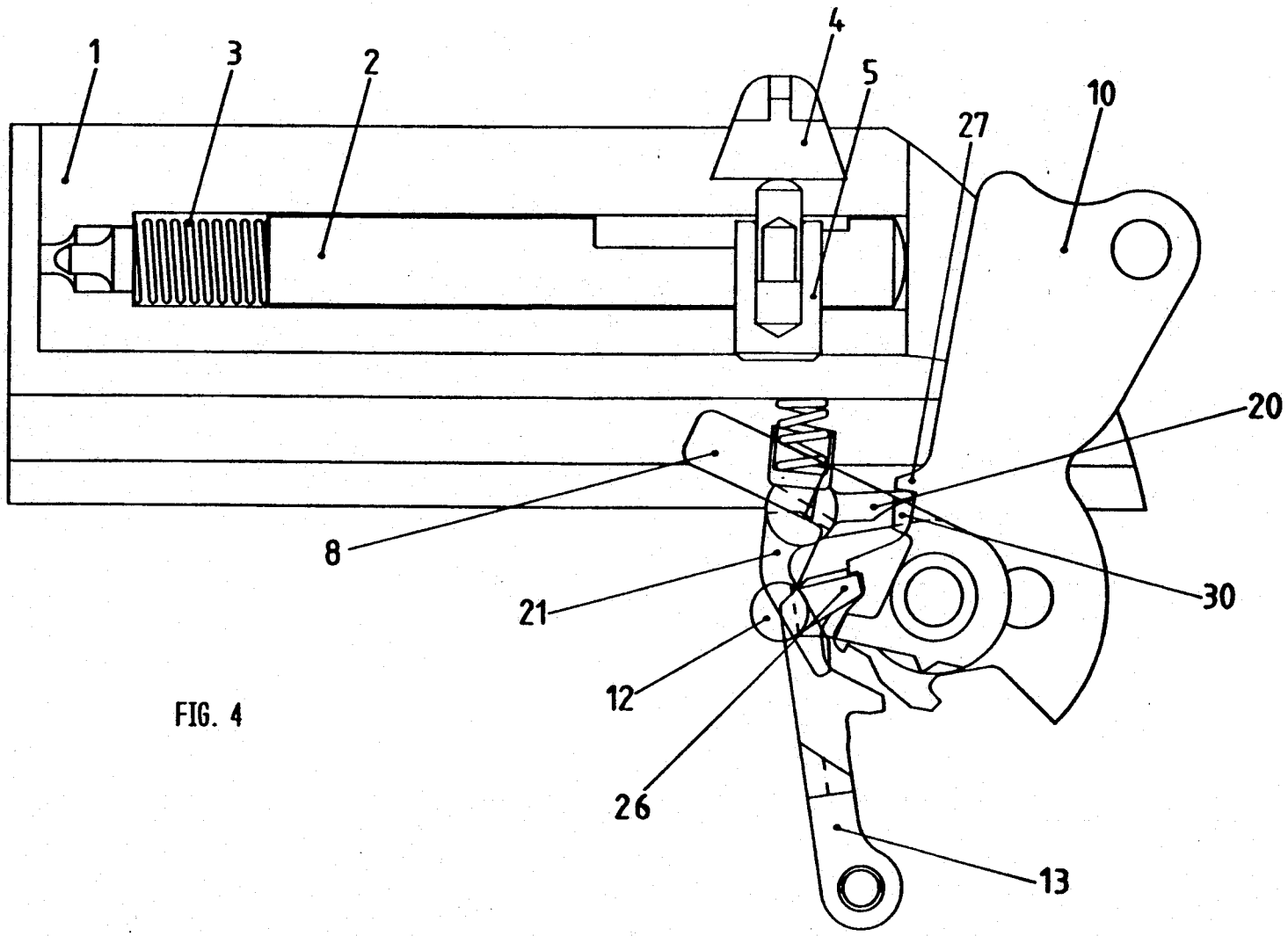
FIG. 4 is a lateral right view of the device, showing the hammer uncocked and locked.

As it can be seen in FIG. 4, the retention arm (20)of the retentor (17) remains horizontally positioned after the beating back of the hammer (10) even after the decocking of the hammer (10), same after the return of the keys (7, 8) to the neutral horizontal position, due to the resistence offered by the dent (27) of the hammer (10) to the tip of the retention arm (20), neutralizing the torque produced by the plunger (24) over the edge of the indenture (19) of the axle (18) of the retentor (17).

Figure 5:
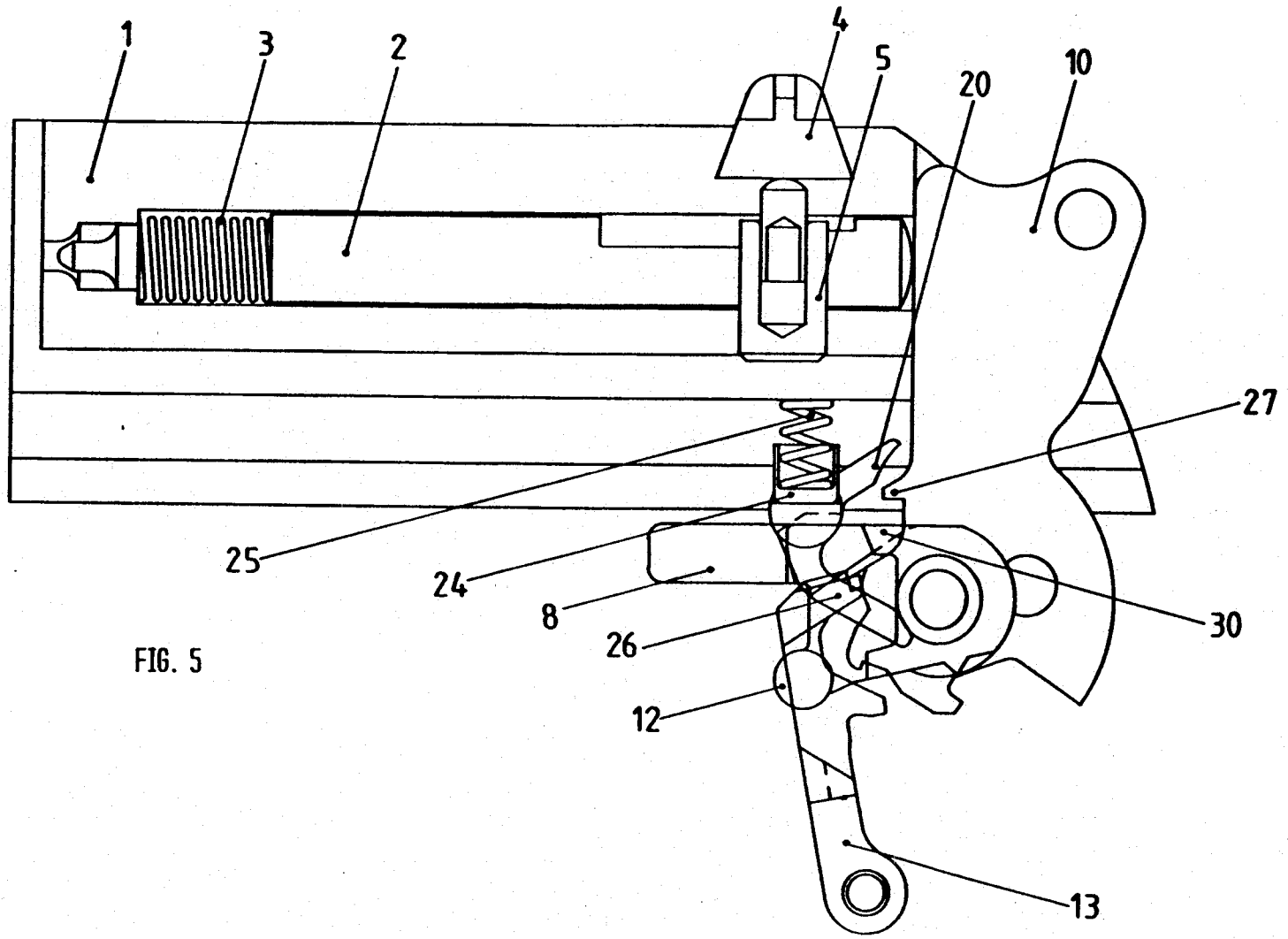
FIG. 5 is a lateral right view of the device, showing the mechanism in unlocking procedure.

The retention arm (20), once horizontally positioned, returns to the oblique position with relation to the horizontal axle of the pistol, when the hammer (10) is put in action due to the ceasing of the resistance offered by the dent (27) of the hammer (10) to the tip of the retention arm (20), and the torque produced by the plunger (24) over the edge of the indenture (19) of the axle (18) of the retentor (17), as it can be observed in FIG. 5.

On its turn, the locking of the pistol can be also accomplished by turning the keys (7, 8) to the upper position, setting the arm (12) of the second key (8) in the position to block the movement of the sear (13), actuating on its face (29) impeding the hammer releasing and tile consequent shooting. Such locking status can be obtained not only after the beating back of the hammer (10), as illustrated in FIG. 4 but also with the hammer (10) cocked, as illustrated in FIG. 1.

Figure 6:
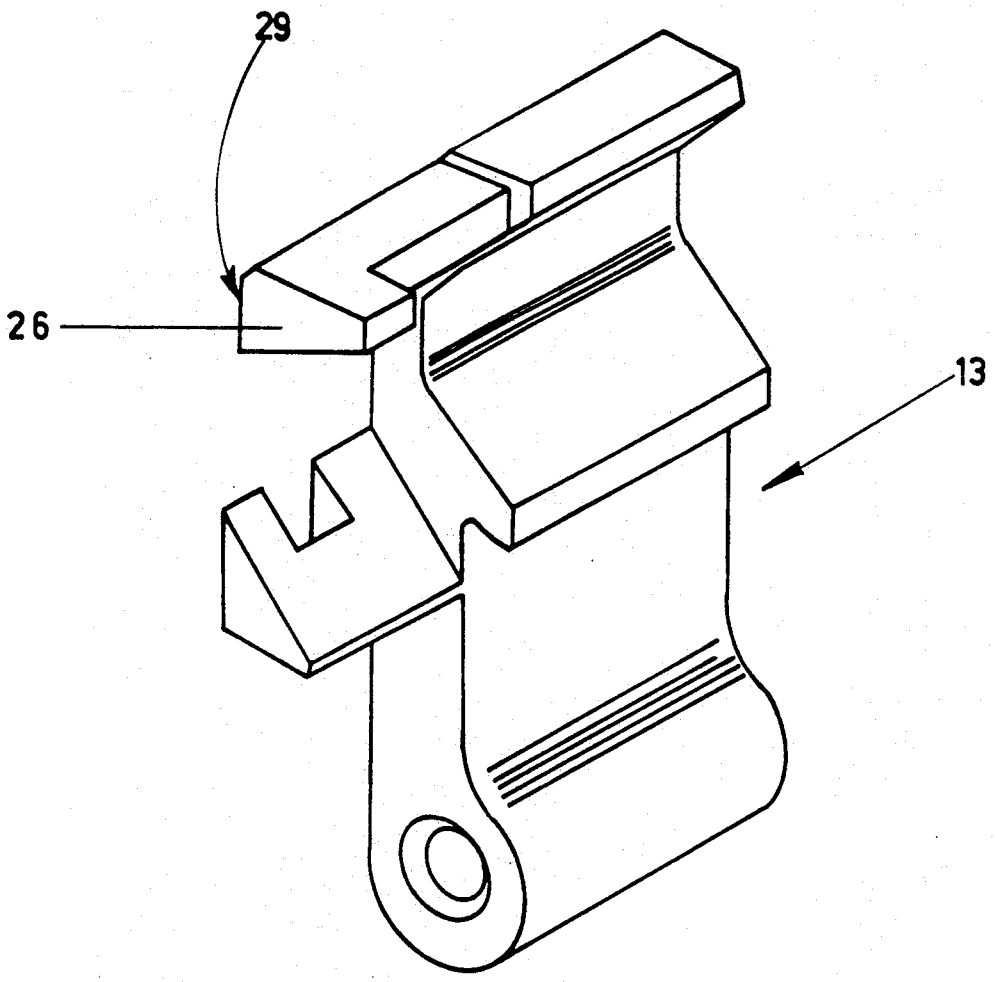
FIG. 6 is a perspective view of the sear which integrates the safety device, object of the present invention.
Figure 7:
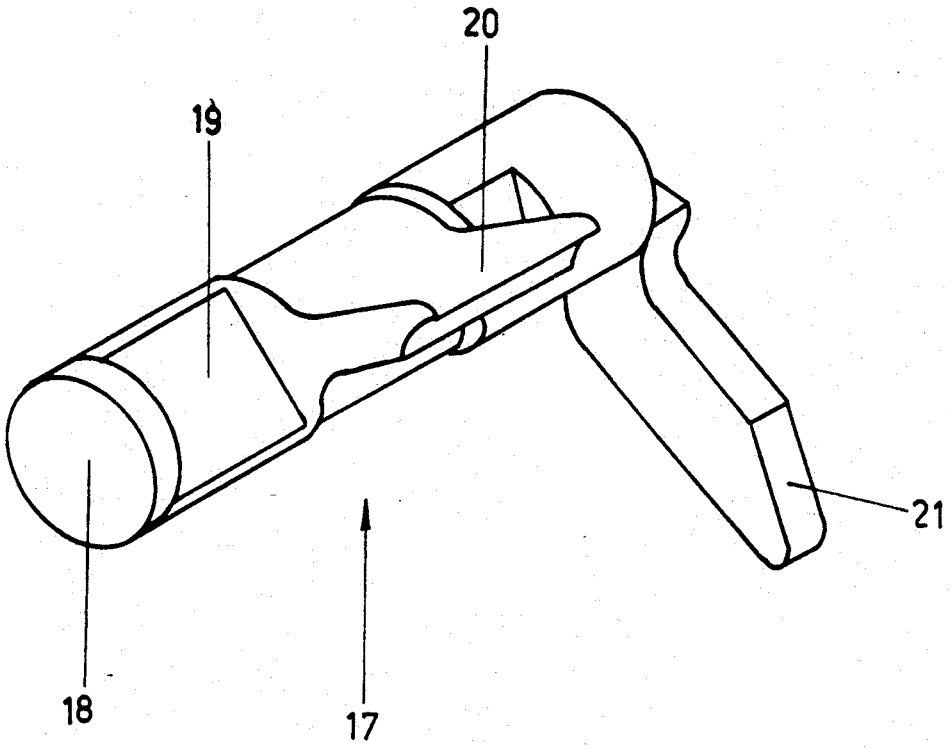
FIG. 7 is a perspective view of the retentor that integrates the, safety device, object of the present invention.

In a preferred operation, as per FIG. 6 the lateral projection (26) of the sear (13) consists of a lateral projection whose section defines a trapezium. In a preferred operation, the retentor (17) comprises an cylindric axle(18), endowed with an indenture (19) in the shape of cylindric cap close to one of its ends, a retention arm (20) projected from the central portion of the axle (18) with a horizontal dimension longer than the vertical one, and a driving lever (21), projected from the other end of the axle (18) with a vertical dimension longer or equal to he horizontal one, as shown in FIG. 7.

Figure 8:
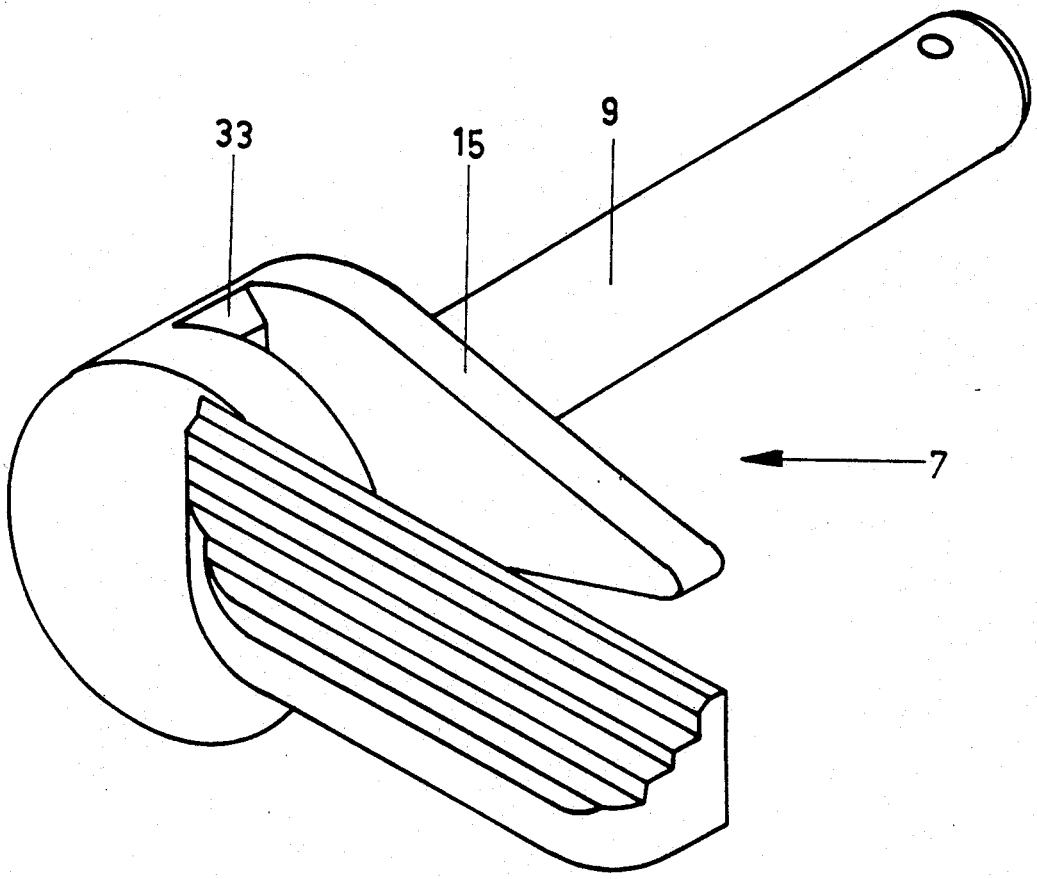
FIG. 8 is a perspective view of the first key that is part of the safety device, object of the present invention.
Figure 9:
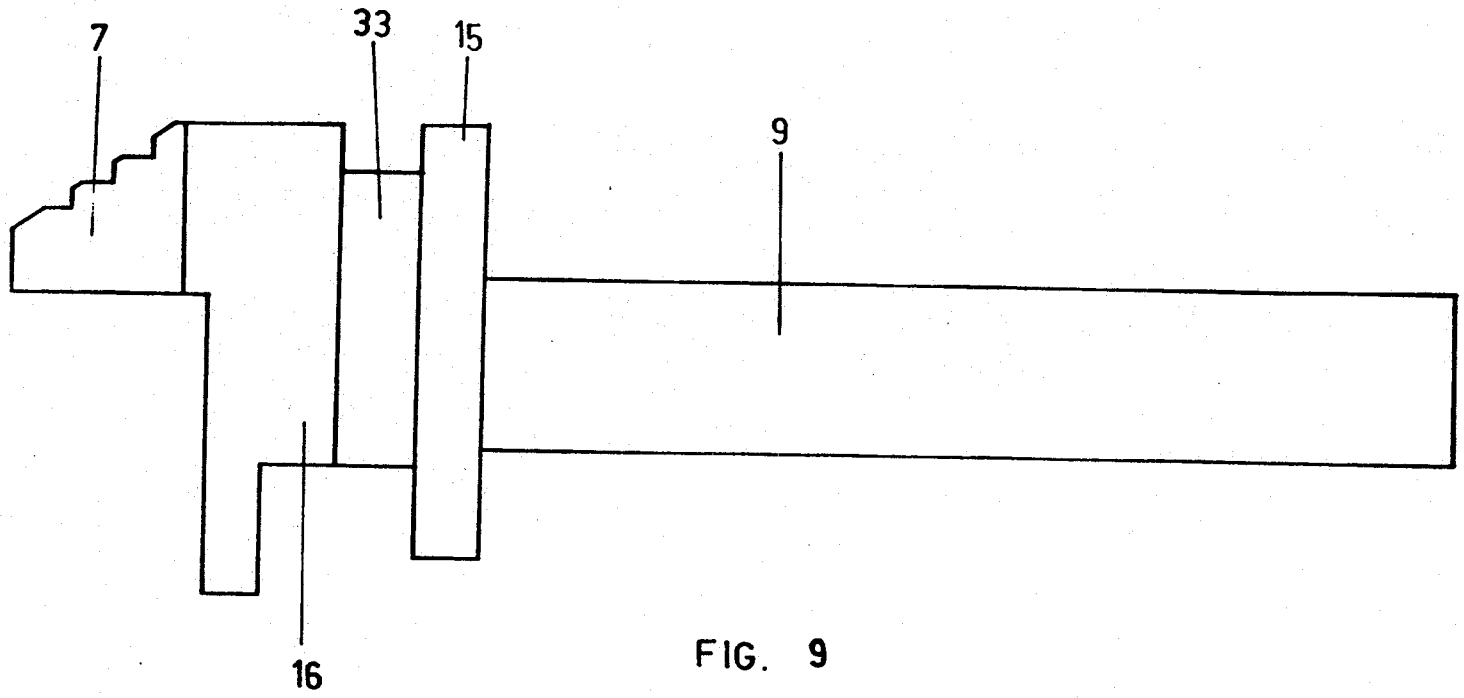
FIG. 9 is a front view of the first key showed in FIG. 12.

According to the FIGS. 8 and 9, preferably the first key (7) is linked to the cam (,15) by an intermediary portion (33), and said cam (15) is linked to one of the ends of the axle (9).

Figure 10:
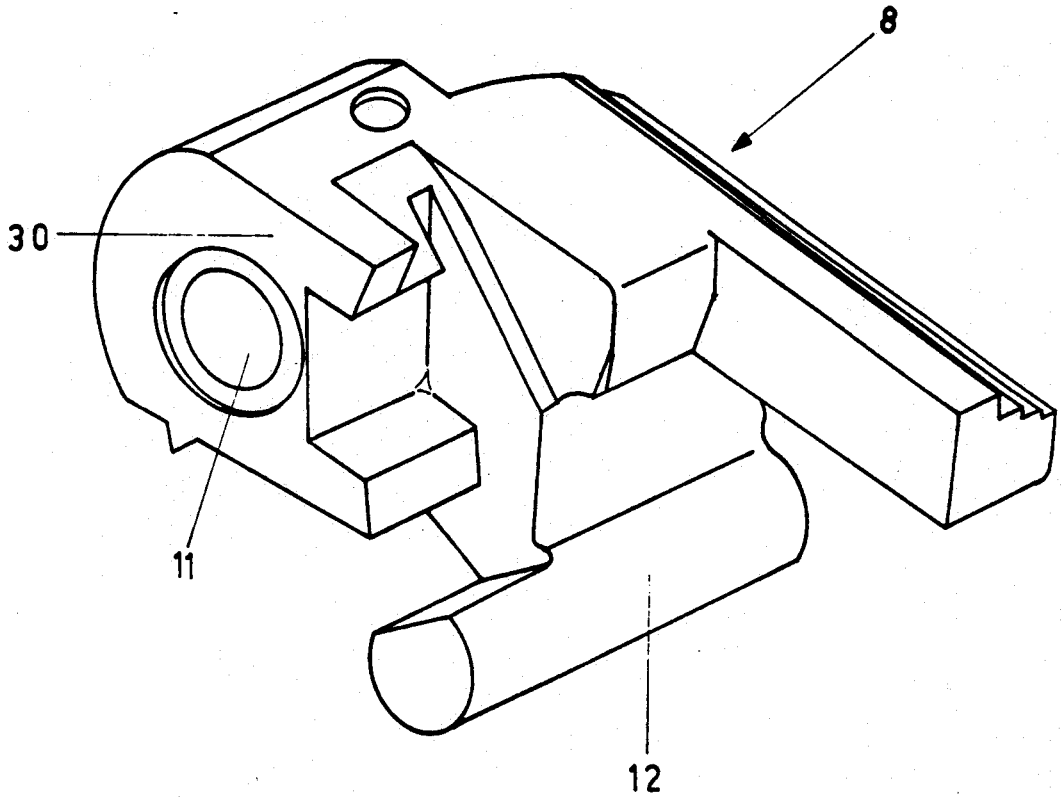
FIG. 10 is a perspective view of the second key which integrates the safety device object of the present invention.

FIG. 10 shows the second key (8), known by the state of the art, with means (11) for fixation of the axle (9) of the first key (7) and an arm 30 that actuates on the lateral projection (26) of the sear (13).

The present safety device can also present an improved click device that comprises a plunger (32) that actuates on the second key (8) and which is destined to keep the keys (7, 8) on the upper and horizontal positions.

I claim:

1. An "IMPROVED SAFETY FOR A SEMIAUTOMATIC PISTOL", of a kind assembled in a frame of the pistol and comprising a three position safety device where an upper position sets in action a pistol locking mechanism, a transitory lower position sets in action a hammer decocking mechanism, and a neutral horizontal position that allows shooting of the pistol; said safety device being composed by two action keys (7, 8), each said key disposed on each side of the pistol, a first key (7) having a first axle (9) on which a hammer (10) is assembled, and a second key (8) having means (11) for holding the axle (9) and a first arm (12) parallel to said axle (9) which blocks a hammer sear (13) acting on a strucking face of the sear (13) when both of said keys (7, 8) are in a locking position and further being characterized by the first key (7) having a cam (15), a retentor

(17) composed by a second axle (18) endowed with an indenture (19) and, from the second axle (18), a retention arm (20) and a driving lever (21) not parallel in relation to each other, an ejector (22) endowed with at least one groove (23) in its lower portion, a plunger (24) that is disposed in said at least one ejector groove (23), and impelled by a helicoidal spring (25) against the indenture (19) of the second axle (18) of the retentor (17); the sear (13) being endowed with a lateral projection (26) and the hammer (10) having a knocking face and being endowed with a dent (27) in a lower portion of said knocking face (28).

2. An "IMPROVED SAFETY" according to claim 1, characterized by the cam (15) of the first key (7) acting over the driving lever (21) of the retentor (17) when the keys (7, 8) go from the neutral horizontal position to the lower position with the hammer (10) cocked, making said retentor (17) perform a rotation movement on said second axle (18), which pressures the plunger (24) against the at least one groove (23) of the ejector (22) compressing the helicoidal spring (25), making the plunger (24) exert torque over the edge of the indenture (19), positioning horizontally the retention arm (20) simultaneously to the action of a second arm (30) of the second key (8) on the lateral projection (26) of the sear (13), releasing the hammer (10) which strikes against a tip of the retention arm (20).

3. An "IMPROVED SAFETY", according to claim 1, characterized by the retention arm (20) of the retentor (17) remaining horizontally positioned after a beating back of the hammer (10) even after the decocking of the hammer (10), and after the return of the keys (7, 8) to the neutral horizontal position, due to a resistance offered by the dent (27) of the hammer (10) to a tip of the retention arm (20), neutralizing a torque produced by the plunger (24) over an edge of the indenture (19) of the second axle (18) of the retentor (17).

4. An "IMPROVED SAFETY", according to claim 1, characterized by the retention arm (20), once horizontally positioned, returning to an oblique position with relation to a horizontal axle of the pistol, when the hammer (10) is put in action due to the ceasing of the resistance offered by the dent (27) of the hammer (10) to a tip of the retention arm (20), and a torque produced by the plunger (24) over an edge of the indenture (19) of the second axle (18) of the retentor (17).

5. An "IMPROVED SAFETY", according to claim 1, characterized by the lateral projection (26) of the sear (13) consisting of a lateral projection whose section defines a trapezium.

6. An "IMPROVED SAFETY", according to claim 1, characterized by the second axle of the retentor (17) comprising a cylindrical axle (18), endowed with the indenture (19) close to a first end of said cylindrical axle, the retention arm (20) projecting from a central portion of the second axle (18) with a horizontal dimension longer than a vertical dimension, and the driving lever (21) projecting from a second end of the second axle (18) with a vertical dimension at least equal to a horizontal dimension.

7. An "IMPROVED SAFETY", according to claim 1, characterized by the first key (7) being linked to the cam 915) by an intermediate portion (33) and said cam (15) being linked to one end of the first axle (9).

* * * * *